US006129031A

United States Patent [19]

Sarh et al.

[11] Patent Number: 6,129,031

[45] Date of Patent: Oct. 10, 2000

[54] ROBOTIC STITCHING APPARATUS AND END EFFECTOR THEREFOR

[75] Inventors: Branko Sarh, Huntington Beach; Ray Palmer, Newport Beach, both of Calif.

[73] Assignee: The Boeing Company, Seattle, Wash.

[21] Appl. No.: 09/441,291

[22] Filed: Nov. 16, 1999

[51] Int. Cl.[7] ..... D05B 21/00; D05B 25/00

[52] U.S. Cl. ..... 112/470.13; 901/41

[58] Field of Search ..... 112/470.13, 470.12, 112/258, 259, 470.01, 470.06; 901/15, 30, 41

[56] References Cited

U.S. PATENT DOCUMENTS

| | | | |
|---|---|---|---|
| 4,577,792 | 3/1986 | Franke, Sr. . | |
| 4,688,499 | 8/1987 | Moore et al. . | |
| 4,688,837 | 8/1987 | Ball et al. . | |
| 4,957,054 | 9/1990 | Sakuma et al. . | |
| 4,996,753 | 3/1991 | Jones . | |
| 5,165,829 | 11/1992 | Ross et al. . | |
| 5,240,299 | 8/1993 | Flavell et al. . | |
| 5,367,966 | 11/1994 | Bellio et al. . | |
| 5,381,743 | 1/1995 | Moll . | |
| 5,400,730 | 3/1995 | Moll et al. . | |
| 5,915,317 | 6/1999 | Thrash et al. | 112/470.13 |
| 5,988,085 | 11/1999 | Martz | 112/470.13 |

OTHER PUBLICATIONS

EOA Systems, Inc., "The Universe of Robot Tooling", brochure (reproduction), 6 pages, EOA Systems, Dallas, Texas.

*Primary Examiner*—Peter Nerbun
*Attorney, Agent, or Firm*—Alston & Bird LLP

[57] ABSTRACT

A stitching apparatus and end effector system particularly suited for stitching composite preforms includes a six-degree-of-freedom manipulator arm and an end effector that is releasably coupled to the end of the manipulator arm by a quick-change coupler system. The end effector comprises a C-shaped bow having a pair of spaced-apart legs the free ends of which support a stitching head and a bobbin in opposing relation so that a workpiece to be stitched can be received between the stitching head and bobbin. In accordance with a preferred embodiment of the invention, a plurality of bows of different configurations are provided, each having a quick-change coupler on each leg for releasably coupling the stitching head and the bobbin to the bow.

14 Claims, 2 Drawing Sheets

ROBOTIC STITCHING APPARATUS AND END EFFECTOR THEREFOR

FIELD OF THE INVENTION

The present invention relates to machines for stitching workpieces having complex three-dimensional shapes. More particularly, the invention relates to apparatus for stitching composite preforms that are used for fabricating composite structural members for aircraft, aerospace structures, and the like.

BACKGROUND OF THE INVENTION

Composite materials are increasingly being used for fabricating structural parts used in aircraft and other applications where the high strength-to-weight ratio and anisotropic nature of composites afford advantages over non-composites. For example, composite materials are being used or studied for use in aircraft wings, horizontal stabilizers, vertical stabilizers, and other parts of aircraft. Such composite parts can be made by first forming a preform of a plurality of non-impregnated plies of fiber material that are laid atop one another so as to form a preform structure having roughly the overall shape of the part to be produced. The preform is impregnated with a matrix material and cured in a mold to produce the finished part.

Some complex part shapes must be produced by assembling a preform from a plurality of component pieces. For example, in fabricating a preform for a composite wing having an outer skin reinforced by stringers and intercostals, the skin, stringers, and intercostals are formed separately. The preform is assembled by securing the stringers and intercostals to the skin and to each other, and then the preform is impregnated and cured to form the finished part. Various techniques can be used for securing the stringers and intercostals to the skin and each other. However, a preferred method in many cases is to stitch the stringer flanges and intercostal flanges to the skin, because stitching provides a greater out-of-plane peel strength between the flanges and the skin than is typically attainable using alternative techniques such as co-curing (i.e., relying on matrix bonding between the flanges and the skin).

Currently, stitching of preforms in this manner is performed using two- or three-degree-of-freedom gantry-type stitching machines. For example, a wing skin preform is laid horizontally on the work surface of the machine and the stringers and intercostals are positioned on the skin in their proper locations, and the stitching device is moved by the machine generally along horizontal directions with the needle moving along a vertical axis so as to stitch the stringer and intercostal flanges to the skin. Where the portion of the preform being stitched is perfectly flat, a two-degree-of-freedom machine is sufficient, since there is no requirement for varying the height of the stitching device relative to the work surface. However, where the preform is contoured so that its height varies along the path over which the stitching device is carried, a three-degree-of-freedom machine is required. These types of machines are complex and expensive.

A further drawback to three-degree-of-freedom machines is that they provide no capability for the needle to be rotated relative to the preform. Accordingly, in portions of the preform where the height of the preform varies along the stitching path, the needle must penetrate the preform in a direction that is not perpendicular to the surface of the preform, which can make stitching more difficult and also cause problems with part quality. More particularly, when the needle passes through the preform in a non-perpendicular direction, the needle must penetrate a greater total thickness of fiber plies than if it penetrated perpendicularly, and thus a longer needle is required and the resistance to the needle is greater. The needle is therefore more prone to problems of excessive bending. Additionally, tensile forces of the thread acting non-perpendicularly tend to pull the fiber plies out of alignment. One possible solution to the problem of needle non-perpendicularity is to use a five-degree-of-freedom gantry-type machine so that the orientation of the needle axis can be changed. Unfortunately, such machines are even more expensive and complex than three-degree-of-freedom machines.

Furthermore, it would be desirable in many cases to be able to stitch parts whose surfaces are essentially vertical, requiring that the needle move along a horizontal axis. For instance, it would be desirable to be able to stitch intercostal flanges to the vertical stringer webs of a composite wing preform. Currently, the intercostal flanges are affixed to the stringer webs by co-curing. Stitching of the intercostal flanges to the stringer webs would provide substantially higher-strength attachment of these parts. However, none of the known commercially available gantry-type machines are capable of stitching vertically oriented parts such as intercostal flanges and stringer webs.

SUMMARY OF THE INVENTION

The above needs are met and other advantages are achieved by the present invention, in which a stitching head and a bobbin of a stitching device are supported by an end effector that is adapted to be releasably coupled to a manipulator arm of a six-degree-of-freedom robotic manipulator. The end effector is advantageously formed as a generally C-shaped bow having a pair of spaced-apart legs that define a space between them for receipt of a portion of a workpiece to be stitched. The stitching head drives a needle and is attached to one of the legs proximate its free end, and the bobbin is attached to the other leg spaced from and opposite to the stitching head, such that the workpiece portion to be stitched can be positioned between the stitching head and bobbin at the distal end of the bow. The end effector is releasably coupled to the manipulator arm by a coupler that is attached to the bow at a location spaced from the distal end of the bow in the direction of the bow axis toward the opposite or proximal end of the bow. The bow coupler preferably is a quick-change coupler enabling rapid attachment of the bow to the manipulator arm. The manipulator arm is operable to position the end effector in any desired location and orientation for stitching complex-shaped workpieces. Furthermore, the manipulator arm is able to position the end effector such that substantial perpendicularity of the needle to the workpiece surface is maintained.

In accordance with a preferred embodiment of the invention, the end effector includes a pair of cooperative stitching head couplers, one of the stitching head couplers being affixed to the first leg of the bow and the other stitching head coupler being affixed to the stitching head. The stitching head couplers are operable to releasably engage each other so as to secure the stitching head to the first leg of the bow. Similarly, the end effector includes a pair of cooperative bobbin couplers, one of the bobbin couplers being affixed to the second leg of the bow and the other bobbin coupler being affixed to the bobbin, the bobbin couplers being operable to releasably engage each other so as to secure the bobbin to the second leg of the bow. Accordingly, the stitching head and bobbin can be easily removed from one bow and secured to another bow having a different configuration adapted to a different workpiece configuration. Additionally, in accordance with another preferred embodiment of the invention, a stitching apparatus is provided having a plurality of bows of various configurations for stitching workpieces of different configurations. A significant advantage of this stitching apparatus is that the bows are relatively easily fabricated and are inexpensive in comparison to the stitching head and bobbin, and thus a wide variety of workpiece configurations can be stitched while minimizing capital expenditures for a large number of separate dedicated end effectors each having its own stitching head and bobbin.

A wide variety of bow configurations can be made. For example, in one preferred embodiment, the bow is configured such that the workpiece-receiving space has a width in the transverse direction (i.e., generally parallel to the axis of the needle) that is generally constant from the distal end to the proximal end of the bow. Alternatively, the bow is configured such that the workpiece-receiving space has a width in the transverse direction that is smaller at the distal end than at the proximal end of the bow. Bows having various lengths of the legs along the bow axis and various widths in the transverse direction can be provided.

The invention thus enables workpieces having complex shapes to be stitched. The invention further enables such complex workpieces to be stitched while maintaining perpendicularity of the needle to the workpiece surface. Additionally, the invention facilitates stitching a wide variety of workpiece shapes with minimal investment in end effector equipment.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
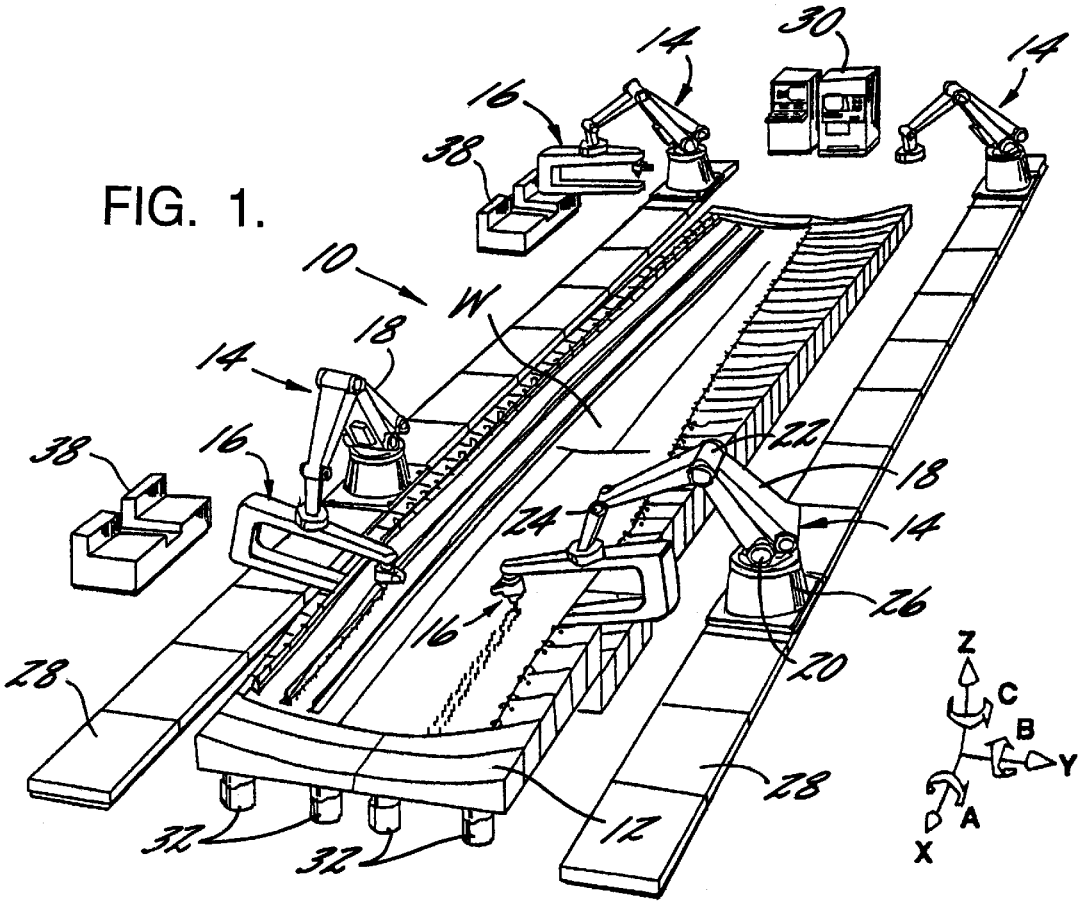
FIG. 1 is perspective view of a robotic stitching apparatus in accordance with one preferred embodiment of the invention, showing the apparatus stitching a composite preform for an aircraft wing section.

With reference to FIG. 1, an apparatus 10 in accordance with a preferred embodiment of the invention is shown performing a stitching operation on a section of an aircraft wing preform W. The apparatus 10 includes a workpiece support table 12 for supporting the workpiece W, and at least one robotic manipulator 14 (four shown) that manipulates a stitching end effector 16 for stitching the workpiece. In the preferred embodiment of the invention shown in FIG. 1, the manipulator 14 has a manipulator arm 18 having a shoulder joint 20 rotatable about a horizontal axis perpendicular to the vertical axis, an elbow joint 22 rotatable about an axis parallel to the horizontal rotation axis of the shoulder joint, and a wrist joint 24 rotatable about an axis parallel to the elbow joint rotation axis. The manipulator arm 18 is attached at the fixed end to a turret 26 that is rotatable about a vertical axis perpendicular to the horizontal rotation axis of the shoulder joint 20. The turret 26 is translatable along the horizontal X-axis direction by virtue of a rail 28 on which the turret 26 is slidably mounted. Thus, the manipulator 14 is advantageously a six-degree-of-freedom device capable of translating the end effector 16 along three mutually orthogonal X, Y, and Z axes and of rotating the end effector 16 about these axes. However, the invention is not limited to the particular type of six-degree-of-freedom device shown. Although not shown, it will be understood that suitable actuators are connected to the manipulator 14 for controlling the various motions of the manipulator. The actuators are controlled by a suitable controller 30 that can be programmed with information relating to the path along which the end effector 16 is to be carried during a stitching operation.

Preferably, as shown in FIG. 1, there may be two or more manipulators 14 spaced apart along the rail 28 such that a very long part, such as a section of an aircraft wing W, can be simultaneously stitched in different locations by two or more manipulators 14 each manipulating a stitching end effector 16. If desired, a rail 28 can be located on each side of the work table 12, each rail carrying one or more manipulators 14. The work table 12 can, if desired, be a variable-geometry table formed of a plurality of portions connected to one another such that the contour of the table can be adjusted, such as by pogos 32, to match the contour of the workpiece being supported.

Figure 2:
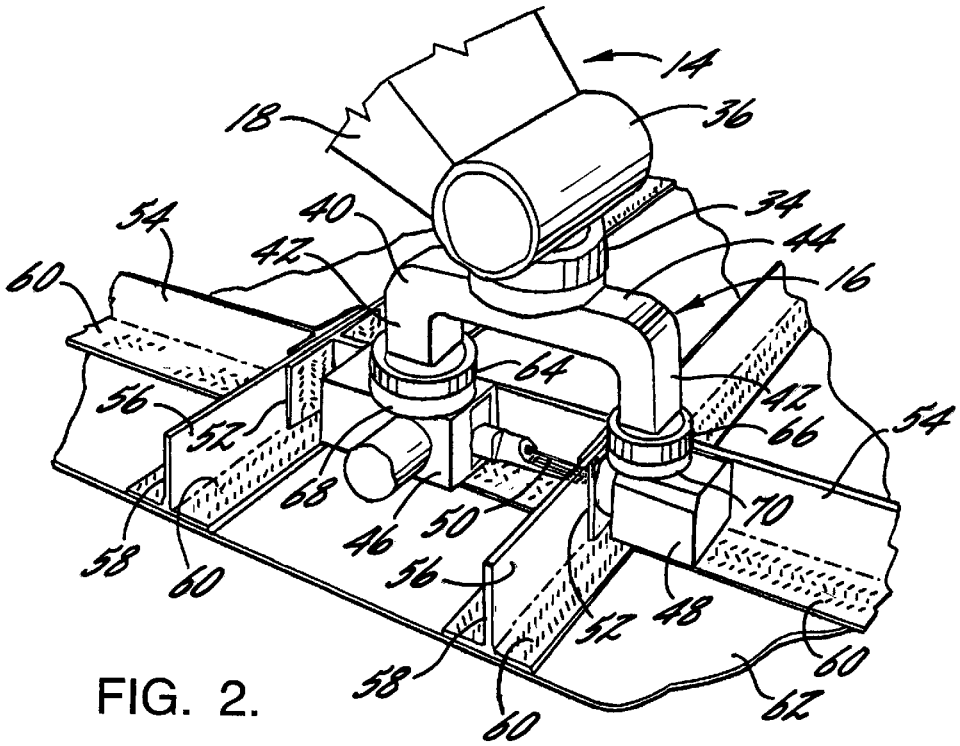
FIG. 2 is a perspective view of an end effector in accordance with a preferred embodiment of the invention attached to the end of a manipulator arm, showing the end effector stitching an intercostal flange to the vertical web of a stringer on an aircraft wing section.

With reference to FIG. 2, the end effector 16 is connected to the free end of the manipulator arm 18 preferably by a quick-change coupler 34 that is operable to permit the end effector 16 to be released from the end of the manipulator arm 18 automatically upon actuation of a cooperating coupler 36 affixed to the end of the manipulator arm. Similarly, the end effector 16 can be attached to the manipulator arm 18 by activation of the coupler 36. Preferably, as shown in FIG. 1, the manipulator 14 has access to a storage rack 38 in which are stored a plurality of end effectors 16, and the manipulator 14 thus is capable of automatically coupling itself to a selected one of the end effectors 16 in the rack 38 for performing a stitching operation on a particular workpiece or portion thereof. After completion of a stitching operation, the manipulator 14 can, if the controller 30 is suitably programmed, return the end effector 16 to the rack 38. Furthermore, if the controller 30 is suitably programmed, the manipulator 14 can then select a different end effector 16 of a different configuration for stitching a different workpiece or a different portion of the same workpiece.

The end effector 16 preferably is formed as a generally C-shaped structure. With reference to FIG. 2, the end effector 16 includes a C-shaped bow 40 formed by a pair of spaced-apart and generally parallel legs 42 affixed to opposite ends of a connector beam 44. A stitching head 46 is attached to the free end of one of the legs, and a bobbin 48 is attached to the free end of the other leg opposite to and spaced from the stitching head. The stitching head 46 is operable to drive a needle 50 in reciprocating fashion along a needle axis that extends in a transverse direction of the bow 40 from the one leg 42 to the other leg 42. The stitching head 46 and bobbin 48 cooperate to stitch a workpiece positioned between them. For example, FIG. 2 depicts an end effector 16 configured for stitching the flanges 52 of intercostal ribs 54 to the vertical web 56 of a stringer 58. Additionally, the flanges 60 of the stringers 58 and intercostals 54 can be stitched to the skin 62 by a different end effector, such as the end effector 16 shown in FIG. 1, suitably configured with a bow having legs 42 that are long enough to be able to reach the flanges 60.

More particularly, the invention contemplates end effectors of various geometries each configured for stitching a differently configured workpiece. It will be appreciated, however, that given the vast array of different workpiece geometries that could conceivably be candidates for stitching, a large number of different end effector geometries may be needed, which could require a large investment in capital equipment. The present invention helps minimize capital expenditures by providing a modular end effector system enabling end effectors of various geometries to be constructed using common stitching heads and bobbins releasably coupled to bows of different geometries.

With reference to FIG. 2, the end effector 16 includes a stitching head coupler 64 affixed to the one leg 42 and a bobbin coupler 66 affixed to the other leg 42. The stitching head coupler 64 is operable to coact with a cooperating stitching head coupler 68 affixed to the stitching head 46 for releasably coupling the stitching head 46 to the bow 40. Similarly, a bobbin coupler 70 is affixed to the bobbin 48 and coacts with the bobbin coupler 66 on the bow 40 for releasably coupling the bobbin 48 to the bow. Thus, the stitching head 46 and bobbin 48 can easily be removed from the bow 40 and coupled to a differently configured bow for stitching a differently configured workpiece.

Quick-change coupling devices suitable for coupling an end effector 16 to the manipulator arm 18 and for coupling a bobbin and stitching head to an end effector are known in the art. For example, a Model 30 Quick Change Adapter available from EOA Systems, Inc. of Dallas, Tex., can suitably be used for such purposes. Additionally, U.S. Reissue Pat. No. Re32,854, incorporated herein by reference, describes a quick-change adapter substantially corresponding to the EOA Quick Change Adapter and which can suitably be used in connection with the present invention. This quick-change adapter comprises a pneumatically actuatable latching mechanism and a cooperative tool mounting plate that is mounted on the tool to be attached by the latching mechanism. The latching mechanism pulls the tool mounting plate into the body of the mechanism and preloads the plate for providing a rigid connection therebetween. Accordingly, for example, the tool mounting plate can be affixed to the end effector 16 and the latching mechanism can be mounted to the end of the robotic manipulator arm 18. Likewise, a tool mounting plate can be mounted on a bobbin and a latching mechanism mounted on one arm of the end effector, and a tool mounting plate can be mounted on a stitching head and a latching mechanism mounted on the other arm of the end effector. It is within the skill of a person of ordinary skill in the art to devise suitable quick-change coupling devices for releasably affixing the end effector to the robot arm and for releasably affixing the bobbin and stitching head to the end effector.

Figure 3A:
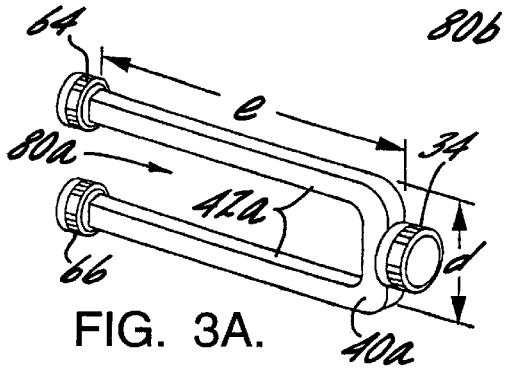
FIGS. 3A–3E are perspective views of a number of differently configured bows for end effectors in accordance with the present invention.

FIGS. 3A–3E show several illustrative examples of bows for constructing end effectors of different geometries. FIG. 3A shows a bow 40*a* in which the legs 42*a* have a length e that is substantially greater than the transverse width d of the bow. The bow 40*a* thus has a relatively long and narrow space 80*a* between the legs 42*a* for receiving a portion of a workpiece to be stitched. Accordingly, the bow 40*a* is capable of positioning a stitching head and bobbin substantially inward of a free edge of a workpiece, as long as the portion of the workpiece that extends into the workpiece-receiving space 80*a* is not thicker than the transverse spacing between the legs 42*a*.

Figure 3B:
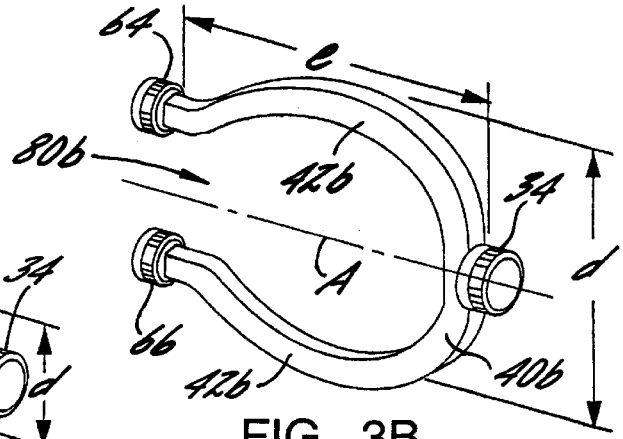

FIG. 3B shows a horseshoe-shaped bow 40*b* having a length e that is about the same as the transverse width d of the bow. T he legs 42*b* extend generally parallel to a longitudinal axis A of the bow that extends from the proximal end to the distal end, but curve inward toward each other at their free ends. The bow 40*b* thus defines a workpiece-receiving space 80*b* that has a substantial transverse width and is slightly wider in the middle than at the distal end of the bow having the stitching head coupler 64 and bobbin coupler 66. The bow 40*b* is suitable for stitching workpieces in which an edge portion of the workpiece extending into the space 80*b* has a greater thickness than the portion of the workpiece being stitched.

Figure 3C:
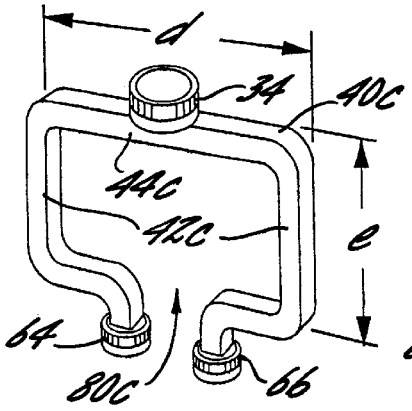

FIG. 3C shows a bow 40*c* in which the width d is somewhat greater than the length e. The legs 42*c* are straight and parallel near the proximal end of the bow where the legs 42*c* attach to the connecting beam 44*c*, but are bent inward toward each other at their free ends such that the workpiece-receiving space 80*c* is wide in the middle and near the proximal end of the bow having the bow coupler 34 and is substantially narrower at the distal end of the bow having the stitching head coupler 64 and bobbin coupler 66. The bow 40*c* is suitable for stitching workpieces in which an edge portion of the workpiece extending into the space 80*c* has a substantially greater thickness than the portion of the workpiece being stitched.

Figure 3D:
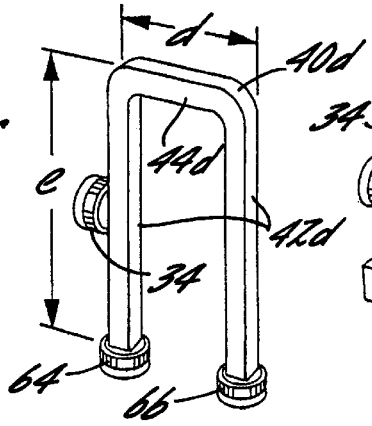

FIG. 3D shows a bow 40*d* generally similar to the bow 40*a*, but having the bow coupler 34 attached to the leg 42*d* having the stitching head coupler 64 rather than to the connecting beam 44*d*. Thus, while the bows 40*a–c* are particularly suited for stitching vertically oriented parts such as illustrated in FIG. 2, the bow 40*d* is particularly suited for stitching horizontally oriented parts such as illustrated in FIG. 1.

Figure 3E:
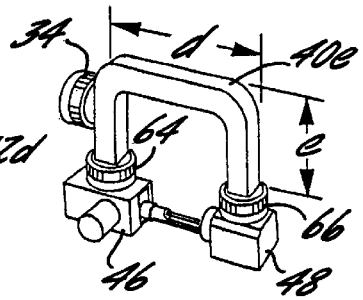

FIG. 3E shows a bow 40*e* generally similar to the bow 40*d*, but having a substantially smaller length e than that of the bow 40*d*. The bow 40*e* is adapted for stitching vertically oriented parts in which the location of the stitching is only slightly below a free upper edge of the part, while the bow 40*d* is better suited for stitching vertically oriented parts in which the stitching location is farther below the upper edge of the part. While the bow 40*d* could be used for stitching only slightly below an upper edge of a part, it is generally advantageous to keep the moment arm between the bow coupler 34 and the stitching head 46 as small as possible to minimize bending moments on the end effector.

The invention thus provides the capability to stitch a wide variety of workpiece configurations through the use of a plurality of bows that can be easily coupled to a common stitching head and bobbin, as opposed to employing a like number of dedicated end effectors each having its own stitching head and bobbin. The bows are relatively easy and inexpensive to manufacture since they serve primarily a structural support function for the stitching head and bobbin and thus are relatively simple in construction. Accordingly, a wide variety of end effector geometries can be attained relatively inexpensively.

Figure 4:
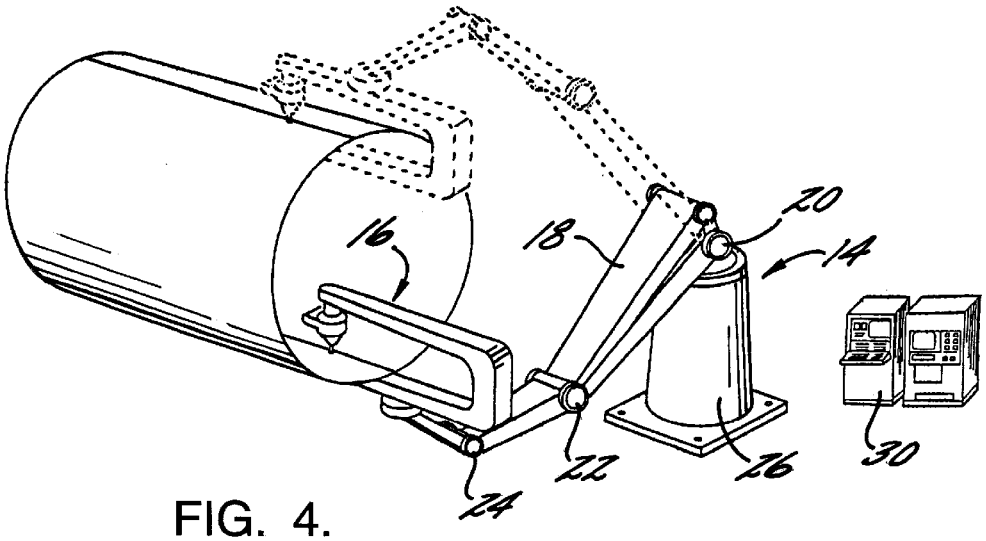
FIG. 4 is a perspective view of an apparatus in accordance with another preferred embodiment of the invention, showing the apparatus stitching a cylindrically shaped workpiece.

While the invention has been illustrated thus far in connection with aircraft wing sections, other structures of substantially different shape can be stitched with apparatus in accordance with the invention. For example, FIG. 4 shows a hollow cylindrical workpiece being stitched along a lower portion by a manipulator 14 with end effector 16. As shown in phantom line, the manipulator 14 is capable of positioning the end effector 16 for stitching an upper portion of the workpiece, as well as positions in between the upper and lower positions. By virtue of its six-degree-of-freedom motion, the manipulator 14 is able to continuously adjust the position of the end effector 16 throughout a stitching operation such that the needle is maintained substantially perpendicular to the surface of the workpiece. Consequently, needle length can be minimized and part quality can be improved.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A stitching end effector for a robotic stitching apparatus having a manipulator arm for positioning the end effector, the end effector comprising:

a bow having a distal end and a proximal end and including spaced-apart first and second legs defining a workpiece-receiving space therebetween, the legs having spaced-apart free ends at the distal end of the bow such that a portion of a workpiece to be stitched can pass between the free ends of the legs into the workpiece-receiving space;

a stitching head affixed to the first leg proximate the distal end of the bow and operable for supporting and driving a needle for stitching a workpiece;

a bobbin affixed to the second leg opposite and spaced from the stitching head such that said portion of the workpiece can be positioned between the stitching head and the bobbin, the bobbin being operable to coact with the stitching head for stitching the workpiece;

a pair of cooperative stitching head couplers, one of the stitching head couplers being affixed to the first leg and the other stitching head coupler being affixed to the stitching head, the stitching head couplers being operable to releasably engage each other so as to secure the stitching head to the first leg of the bow; and a bow coupler affixed to the bow and adapted to releasably couple the bow to the manipulator arm of the robotic sewing apparatus.

2. The stitching end effector of claim 1, further comprising:

a pair of cooperative bobbin couplers, one of the bobbin couplers being affixed to the second leg and the other bobbin coupler being affixed to the bobbin, the bobbin couplers being operable to releasably engage each other so as to secure the bobbin to the second leg of the bow.

3. The stitching end effector of claim 1, wherein the bow includes a connecting beam and the first and second legs are attached to opposite ends of the connecting beam, and wherein the bow coupler is attached to one of the connecting beam, the first leg, and the second leg.

4. The stitching end effector of claim 1, wherein the bow defines a bow axis extending from the proximal end toward the distal end of the bow, the legs being spaced on opposite sides of the bow axis, and wherein the connecting beam extends between the legs in a transverse direction generally perpendicular to the bow axis.

5. The stitching end effector of claim 4, wherein the bow is configured such that the workpiece-receiving space has a width in the transverse direction that is generally constant from the distal end to the proximal end of the bow.

6. The stitching end effector of claim 4, wherein the bow is configured such that the workpiece-receiving space has a width in the transverse direction that is smaller at the distal end than at medial portions of the bow.

7. A robotic stitching apparatus for stitching three-dimensional workpieces, comprising:

a six-degree-of-freedom manipulator having a manipulator arm with an end effector coupler attached to a free end of the manipulator arm;

a stitching end effector formed as a generally C-shaped bow having spaced-apart first and second legs defining a workpiece-receiving space therebetween, the legs having spaced-apart free ends such that a portion of a workpiece to be stitched can pass between the free ends of the legs into the workpiece-receiving space, the first and second legs respectively supporting a stitching head that drives a needle along a stitching axis and a bobbin that are cooperable for stitching said portion of the workpiece positioned between the free ends of the legs, the stitching end effector having an end effector coupler affixed to the bow and cooperable with the end effector coupler on the manipulator arm so as to releasably secure the stitching end effector to the free end of the manipulator arm; and the manipulator arm being operable to continuously adjust the position and orientation of the end effector relative to the workpiece such that the needle axis is maintained substantially perpendicular to an outer surface of the portion of the workpiece.

8. The robotic stitching apparatus of claim 7, wherein the stitching end effector includes a pair of cooperable stitching head couplers, one of the stitching head couplers being affixed to the first leg and the other stitching head coupler being affixed to the stitching head, the stitching head couplers being operable to releasably engage each other so as to secure the stitching head to the first leg of the bow.

9. The robotic stitching apparatus of claim 8, wherein the stitching end effector includes a pair of cooperable bobbin couplers, one of the bobbin couplers being affixed to the second leg and the other bobbin coupler being affixed to the bobbin, the bobbin couplers being operable to releasably engage each other so as to secure the bobbin to the second leg of the bow.

10. The robotic stitching apparatus of claim 9, further comprising a plurality of bows each having an end effector coupler, a stitching head coupler and a bobbin coupler, each bow having a length measured along a bow axis from the proximal end to the distal end and a width measured normal to the bow axis, the combination of length and width of each bow being unique to that bow, whereby the end effector geometry is varied by coupling a selected one of the bows to the manipulator arm and coupling the stitching head and bobbin to the selected bow.

11. A bow for a stitching end effector, comprising:

spaced-apart first and second legs defining a workpiece-receiving space therebetween, and a connector beam extending generally in a transverse direction between and joined to the legs, the legs having spaced-apart free ends such that a portion of a workpiece to be stitched can pass between the free ends of the legs into the workpiece-receiving space, the connector beam and legs defining a generally C-shaped bow having a proximal end at the connector beam and a distal end at the free ends of the legs, wherein the bow is configured such that the workpiece-receiving space has a width in the transverse direction that is smaller at the distal end than at medial portions of the bow;

a stitching head coupler affixed to the first leg proximate the distal end of the bow and operable to releasably engage a coupling device on a stitching head so as to secure the stitching head to the first leg of the bow;

a bobbin coupler affixed to the second leg proximate the distal end of the bow and operable to releasably engage a coupling device on a bobbin so as to secure the bobbin to the second leg of the bow; and a bow coupler affixed to the bow at a location spaced from the distal end toward the proximal end and adapted to releasably couple the bow to a manipulator arm of a robotic sewing apparatus.

12. The bow of claim 11, wherein the bow defines a bow axis extending from the proximal end toward the distal end of the bow, the legs being spaced on opposite sides of the bow axis, and wherein the connecting beam extends between the legs in the transverse direction generally perpendicular to the bow axis.

13. The bow of claim 11, wherein the bow coupler is attached to the connecting beam.

14. The bow of claim 11, wherein the bow coupler is attached to the first leg.

* * * * *